US007961204B2

(12) United States Patent
Kim

(10) Patent No.: US 7,961,204 B2
(45) Date of Patent: Jun. 14, 2011

(54) METHOD FOR REPRESENTING GRAY SCALE ON PLASMA DISPLAY PANEL IN CONSIDERATION OF ADDRESS LIGHT

(75) Inventor: Yong-Jin Kim, Seongnam (KR)

(73) Assignee: Samsung SDI Co., Ltd., Yongin-si (KR)

( * ) Notice: Subject to any disclaimer, the term of this patent is extended or adjusted under 35 U.S.C. 154(b) by 827 days.

(21) Appl. No.: 11/853,684

(22) Filed: Sep. 11, 2007

(65) Prior Publication Data

US 2008/0062084 A1 Mar. 13, 2008

Related U.S. Application Data

(63) Continuation of application No. 10/800,387, filed on Mar. 12, 2004, now Pat. No. 7,443,405.

(30) Foreign Application Priority Data

Mar. 17, 2003 (KR) ..... 2003-16544

(51) Int. Cl.
*G09G 5/10* (2006.01)
*G09G 3/28* (2006.01)

(52) U.S. Cl. ..... 345/692; 345/60; 345/63; 345/204; 345/690

(58) Field of Classification Search ..... 345/60, 345/63, 67, 68, 204, 690, 691, 692
See application file for complete search history.

(56) References Cited

U.S. PATENT DOCUMENTS 5,541,618 A 7/1996 Shinoda
5,835,072 A 11/1998 Kanazawa
5,898,414 A 4/1999 Awamoto et al.

(Continued)

FOREIGN PATENT DOCUMENTS

CN 1313980 A 9/2001

(Continued)

OTHER PUBLICATIONS

U.S. Office action dated Feb. 20, 2007, for U.S. Appl. No. 10/800,387 (now U.S. Patent 7,443,405), indicating relevance of listed reference Seo et al, "New driving method for gray scale . . . " in this IDS, and U.S. references filed in an IDS on Sep. 11, 2007.

(Continued)

*Primary Examiner* — My-Chau T Tran

(74) *Attorney, Agent, or Firm* — Christie, Parker & Hale, LLP

(57) ABSTRACT

A gray-scale representation method for a plasma display panel, which method includes arranging, in time sequence, a plurality of subfields each having a brightness weight and achieving gray-scale representation by a combination of the subfields, each subfield including an address period and a sustain period. In the gray-scale representation method, the number of sustain pulses for each subfield is determined so that a light generated from the difference of the number of sustain pulses between two adjacent gray scales can be greater than a light discharged in the address period, when the number of subfields for the higher one of the two adjacent gray scales is less than that for the lower one. The reversion of gray scales that occurs when the address light is increased as high as the sustain light can be eliminated to achieve correct gray-scale representation. A smoother gray-scale representation can be achieved with reduced power consumption by adjusting the difference of the number of sustain pulses between the two adjacent gray scales in consideration of the address light.

6 Claims, 4 Drawing Sheets

| Gray scale | Subfield structure | Light structure |
|---|---|---|
| 0 | - | - |
| 1 | 3SF | A |
| 2 | 2SF | A+3 |
| 3 | 2,3SF | 2A+3 |
| 4 | 1,3SF | 2A+5 |
| 5 | 1,2SF | 2A+8 |
| 6 | 1,2,3SF | 3A+8 |
| 7 | 3,4SF | 2A+11 |
| 8 | 2,4SF | 2A+14 |
| 9 | 2,3,4SF | 3A+14 |
| 10 | 1,3,4SF | 3A+16 |

U.S. PATENT DOCUMENTS

| | | | |
|---|---|---|---|
| 6,294,875 | B1 | 9/2001 | Kurata et al. |
| 6,323,880 | B1 | 11/2001 | Yamada |
| 6,353,423 | B1 | 3/2002 | Kang et al. |
| 7,180,481 | B2 | 2/2007 | Yamada |
| 2002/0130826 | A1 | 9/2002 | Otobe et al. |
| 2005/0237277 | A1 | 10/2005 | Kawahara |

FOREIGN PATENT DOCUMENTS

| | | | |
|---|---|---|---|
| JP | 08-146914 | | 6/1996 |
| JP | 08-160915 | | 6/1996 |
| JP | 09-090901 | | 4/1997 |
| JP | 11-065517 | | 3/1999 |
| JP | 2001-142430 | | 5/2001 |
| JP | 2002-132204 | | 5/2002 |
| JP | 2002-304153 | | 10/2002 |
| JP | 2003-066897 | | 3/2003 |
| WO | WO 02/101704 | A1 | 12/2002 |
| WO | WO 03/003338 | A1 | 1/2003 |

OTHER PUBLICATIONS

Seo et al., *New driving method for gray scale expression in AC plasma display panel*, Consumer Electronics, IEEE Transactions, vol. 50, Issue 2, May 2004, pp. 407-412.

Patent Abstracts of Japan, Publication No. 08-146914, dated Jun. 7, 1996, in the name of Isao Kawahara.

Patent Abstracts of Japan, Publication No. 08-160915, dated Jun. 21, 1996, in the name of Isao Kawahara.

Patent Abstracts of Japan, Publication No. 09-090901, dated Apr. 4, 1997, in the name of Atsushi Takahashi et al.

Patent Abstracts of Japan, Publication No. 11-065517, dated Mar. 9, 1999, in the name of Takashi Sasaki et al.

Patent Abstracts of Japan, Publication No. 2001-142430, dated May 25, 2001, in the name of Kazuhiro Yamada.

Patent Abstracts of Japan, Publication No. 2002-132204, dated May 9, 2002, in the name of Takatoshi Shoji.

Patent Abstracts of Japan, Publication No. 2002-304153, dated Oct. 18, 2002, in the name of Seong Ho Kang.

Patent Abstracts of Japan, Publication No. 2003-066897, dated Mar. 5, 2003, in the name of Kazuhiro Yamada.

FIG.2a RELATED ART

| SF weight | 3 | 2 | 1 | 6 | 8 | 10 | 13 | 21 | 32 | 43 | 53 | 63 | 255 |
|---|---|---|---|---|---|---|---|---|---|---|---|---|---|
| The number of sustain pulses | 7 | 5 | 3 | 13 | 17 | 21 | 27 | 43 | 65 | 87 | 107 | 127 | 511 |

FIG.2b RELATED ART

| Gray scale | Subfield structure | Light structure |
|---|---|---|
| 0 | – | – |
| 1 | 3SF | A+3 |
| 2 | 2SF | A+5 |
| 3 | 2,3SF | 2A+8 |
| 4 | 1,3SF | 2A+10 |
| 5 | 1,2SF | 2A+12 |
| 6 | 1,2,3SF | 3A+15 |
| 7 | 3,4SF | 2A+16 |
| 8 | 2,4SF | 2A+18 |
| 9 | 2,3,4SF | 3A+21 |
| 10 | 1,3,4SF | 3A+23 |

Light = Reset light + Address light + Sustain light

FIG.4a

| SF weight | 3 | 2 | 1 | 6 | 8 | 10 | 13 | 21 | 32 | 43 | 53 | 63 | 255 |
|---|---|---|---|---|---|---|---|---|---|---|---|---|---|
| The number of sustain pulses | 5 | 3 | 0 | 11 | 15 | 19 | 25 | 41 | 63 | 85 | 105 | 125 | 509 |

FIG.4b

| Gray scale | Subfield structure | Light structure |
|---|---|---|
| 0 | – | – |
| 1 | 3SF | A |
| 2 | 2SF | A+3 |
| 3 | 2,3SF | 2A+3 |
| 4 | 1,3SF | 2A+5 |
| 5 | 1,2SF | 2A+8 |
| 6 | 1,2,3SF | 3A+8 |
| 7 | 3,4SF | 2A+11 |
| 8 | 2,4SF | 2A+14 |
| 9 | 2,3,4SF | 3A+14 |
| 10 | 1,3,4SF | 3A+16 |

METHOD FOR REPRESENTING GRAY SCALE ON PLASMA DISPLAY PANEL IN CONSIDERATION OF ADDRESS LIGHT

CROSS REFERENCE TO RELATED APPLICATION

This application is a continuation of U.S. application Ser. No. 10/800,387, filed Mar. 12, 2004, which claims priority to and the benefit of Korea Patent Application No. 2003-16544 filed on Mar. 17, 2003 in the Korean Intellectual Property Office, the content of which is incorporated herein by reference.

BACKGROUND OF THE INVENTION (a) Field of the Invention

The present invention relates to a gray-scale representation method for plasma display panels (PDPs). More specifically, the present invention relates to a gray-scale representation method for PDPs that includes determining the number of sustain pulses for each subfield in consideration of address light.

(b) Description of the Related Art

The PDP is a display device that has a plurality of discharge cells arranged in a matrix form that are selectively excited to emit light and thereby to reconstitute image data originally input as electrical signals.

Gray-scale representation must be achieved on the PDP so as to represent the performance of the PDP as a color display device. A gray-scale representation method divides one field into a plurality of subfields and subjects the subfields to time division control to achieve gray-scale representation by subfields.

Each subfield is largely divided into an address period and a sustain period. The address period is for sending data for each pixel to the respective sustain and address electrodes to selectively discharge the individual cells or erase them. The sustain period is for representing gray scale while maintaining the data of each pixel.

Among these methods, the most general method for representing gray scale on PDPs is the ADS (Address Display Separated) method developed by a Japanese company, Fujitsu, that completely separate the address period from the sustain period.

In addition, gray scale related PDP patents are disclosed in U.S. Pat. Nos. 5,835,072, 6,294,875B1 and 6,353,423B1.

The ADS method involves controlling the amount of light for sustain solely to achieve gray-scale representation on PDPs. Namely, the subfield weight as determined by the number of sustain pulses is fixed, or one field is divided into 10 to 12 variable subfields according to the APC (Automatic Power Control) level determined by the load ratio of an image to represent 0 to 255 on a gray scale of 255.

FIG. 1 shows a frame structure in the conventional ADS method.

In the conventional PDP, as illustrated in FIG. 1, reset, address and sustain periods constitute one subfield, and a combination of several subfields forms one frame according to the ADS method.

The light from one subfield is the sum of light emitted during the discharges of address and sustain. Typically, gray scale is represented by a combination of light emitted only during the sustain periods. This is because the amount of the reset or address light is insignificant relative to that of the sustain light.

Recently, development of the PDP technologies has had a tendency to minimize PDP cell dimensions by an increase of the Xenon (Xe) partial pressure and fineness for achieving high brightness, thereby realizing High Definition (HD) PDPs in the true sense of the word, and to change the partition wall structure from the conventional stripe type to a closed type. This reflects the tendency to develop PDPs of high efficiency, high brightness, and fineness.

The tendency to increase the Xe partial pressure, achieve the fineness of cells, and change the partition wall structure to a closed type results in an increase in the amount of light emitted during the address discharge, so that the resultant address light becomes too significant to ignore in the gray-scale representation.

FIG. 2(*a*) shows, for example, the weight and the number of sustain pulses by subfields in the conventional PDP, and FIG. 2(*b*) shows the subfield structure by gray scales represented with a combination of the weights by subfields of FIG. 2(*a*) and the resultant light structure. FIG. 3 is an illustration of light emitted for the subfield in a general PDP.

As shown in FIGS. 2(*a*) and 2(*b*), one frame is comprised of 12 subfields, the sum of the subfield weights is 255, and the total number of sustain pulses is 511. In the figures, the symbol "A" denotes the sum of reset light and address light.

Accordingly, the light emitted for one subfield can be expressed by the following equation:

$$\begin{aligned}\text{one subfield light} &= \text{reset light} + \text{address light} + \text{sustain light} \\ &= A + \text{the number of sustain pulses}\end{aligned} \quad \text{[Equation 1]}$$

It is assumed that the light emitted from one sustain pulse is unit luminescence 1.

Under this subfield weight, the subfield structure of gray scale 1 corresponds to 3SF, that is, the third subfield, and the resultant light structure is A+3. For a gray scale of 6, the subfield structure corresponds to 1SF, 2SF and 3SF, that is, the first, second, and third subfields, and the resultant light structure is 3A+15. For a gray scale of 7, the subfield structure is 3SF and 4SF, that is, the third and fourth subfields, and the resultant light structure is 2A+16.

As described previously, the conventional gray-scale representation is a combination of subfields that only depend on the number of sustain pulses. This can be achieved when the reset light or the address light represented by A is insignificant relative to the sustain light. When A is insignificant, for example, the number of sustain pulses is 15 for a gray scale of 6, and 16 for a gray scale of 7. The gray scale of 7, in this case, has more sustain pulses than the gray scale of 6 and hence the larger total amount of light for subfields to achieve more correct gray-scale representation and higher brightness.

Here, the reset light is not so significant. But, when the address light is equal to or greater than the sustain light, the brightness for the gray scale of 6 becomes equal to or greater than that for the gray scale of 7, as a result of which correct gray-scale representation is difficult to achieve.

More specifically, in the above example, the light structure is 3A+15 for the gray scale of 6 and 2A+16 for the gray scale of 7. When the address light is equal to or greater than the unit sustain light, i.e., $A \geqq 1$, the difference between the gray scale of 6 and the gray scale of 7 is given by the following equation:

$$(3A+15)-(2A+16)=A-1 \geqq 0 \quad \text{[Equation 2]}$$

It can be seen from the equation 2 that the brightness for the gray scale of 6 is equal to or greater than that for the gray scale of 7 to achieve incorrect gray-scale representation when the address light is equal to or greater than the unit sustain light.

Accordingly, the tendency to increase the Xe partial pressure, achieve the fineness of cells, and change the partition wall structure to a closed type for realizing high brightness results in an increase in the amount of light emitted during the address discharge, and the resultant address light becomes too significant to ignore in the gray-scale representation, as a consequence of which correct gray-scale representation is difficult to achieve.

SUMMARY OF THE INVENTION

In accordance with the present invention a method for gray-scale representation on PDPs is provided that achieves smoother and more correct gray-scale representation in consideration of address light.

In one aspect of the present invention, there is provided a gray-scale representation method for a plasma display panel, which method includes arranging, in time sequence, a plurality of subfields each having a brightness weight and achieving gray-scale representation by a combination of the subfields, each subfield including an address period and a sustain period. The number of sustain pulses for each subfield is determined so that a light generated from the difference of the number of sustain pulses between two adjacent gray scales can be greater than a light discharged in the address period, when the number of subfields for the higher gray scale is less than that for the lower one.

Here, the number of sustain pulses having a brightness weight of 1 is determined as zero so that a light for a minimum gray scale comprised of subfields having a brightness weight of 1 can be the light discharged in the address period.

Also, the number of sustain pulses for each subfield is determined so as to make the number of sustain pulses for the higher one of the two gray scales equal to that for the lower one, when the number of subfields for the higher one is greater than that for the lower one.

In another aspect of present invention, there is provided a gray-scale representation method for a plasma display panel, which method includes arranging, in time sequence, a plurality of subfields each having a brightness weight and achieving gray-scale representation by a combination of the respective subfields, each subfield including an address period and a sustain period, the gray-scale representation method including determining the number of sustain pulses for each subfield so that a light for the higher one of two adjacent gray scales (which light includes a light discharged in the whole address period of the subfields combined together to represent the higher gray scale, and a light discharged in the whole sustain period) can be greater than a light for the lower gray scale (which light includes a light discharged in the whole address period of the subfields combined together to represent the lower gray scale, and a light discharged in the whole sustain period).

BRIEF DESCRIPTION OF THE DRAWINGS

FIG. 2(*a*) shows the weight and the number of sustain pulses by subfields in a conventional PDP.

FIG. 2(*b*) shows a subfield structure by gray scales represented with a combination of the weights by subfields of FIG. 2(*a*), and the resultant light structure.

FIG. 4(*a*) shows the weight and the number of sustain pulses by subfields in a PDP according to an embodiment of the present invention.

FIG. 4(*b*) shows a subfield structure by gray scales represented with a combination of the weights by subfields of FIG. 4(*a*) and the resultant light structure.

DETAILED DESCRIPTION

Figure 1:
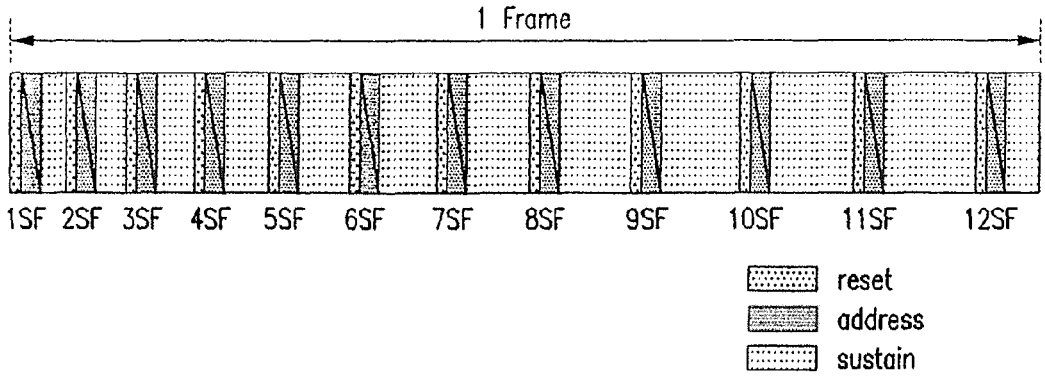
FIG.1 RELATED ART
FIG. 1 shows a frame structure in the conventional ADS method.
Figure 3:
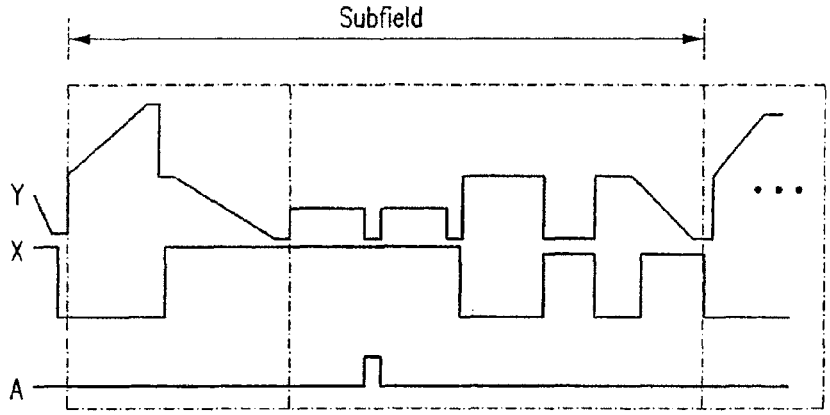
FIG.3 RELATED ART
FIG. 3 shows light emitted for the subfield in a general PDP.

Inaccurate representation of brightness by gray scales results from adjacent gray scales, when the address light increases significantly to be equal to or greater than the sustain light. Thus, the factor expected to cause a variation of the light structure by adjacent gray scales is determined, and the factor for considering the address light is then detected to enable correct gray-scale representation despite the increased address light.

For adjacent gray scales, there is a variation of at most one in the aspect of the subfield structure. Namely, the variation is at most 1A in regard to the light structure. The number of sustain pulses is the same or increases with an increase in the gray scale.

Accordingly, variation factors of the light structure are given as follows when the gray scale increases to its adjacent one.

For the first factor, the number of subfields is constant and only the number of sustain pulses changes. In this case, the number of sustain pulses is only increasing, i.e., there is no variation of A in regard to the light structure.

For the second factor, the number of subfields increases and that of sustain pulses changes. In this case, the number of subfields increases by one and that of sustain pulses is only increasing. Namely, there is an increment of 1A in addition to the first factor in regard to the light structure.

For the third factor, the number of subfields decreases and that of sustain pulses changes. In this case, the number of subfields decreases by one and that of sustain pulses is only increasing. Namely, there is a decrement of 1A in addition to the first factor in regard to the light structure.

Among the variation factors of the light structure, the first factor involves no change of the address light and the second one includes the increasing address light. So, incorrect gray-scale representation is not achieved.

But, the third factor, which involves an increase in the address light to cause an incorrect gray-scale representation, is the factor for which the address light must be taken into consideration.

The third factor includes a decrease in the address light A and an increase in the number of sustain pulses. Despite these variations, an increment of brightness due to the variations is necessary for correct gray-scale representation. This can be expressed by the following equation:

$$\text{Increment of the number of sustain pulses} > A \qquad \text{[Equation 3]}$$

As can be seen from the equation 3, the increment of the number of sustain pulses must be greater than the address light A so that the higher one of the two adjacent gray scales with a decrement of the number of subfields has a higher brightness than the lower one.

The symbol "A" indicates the address light (in case of reset light ignorable), which is typically lower than the 3-unit sustain light, i.e., $A<3$. Thus correct gray-scale representation can be achieved by consideration of the address light when the increment of the number of sustain pulses is at least 3.

For that reason, when the number of subfields for the higher one of the two adjacent gray scales is less than that for the lower one, it is necessary to control the weight of each subfield so that the higher gray scale should have at least 3 sustain pulses more than the lower one.

It can be readily understood to those skilled in the art that the increment of the number of sustain pulses must be increased relatively when the address light appears greater than the 3-unit sustain light.

The above description has been given as to the case where the brightness is represented as reversed between the two adjacent gray scales as in the third factor. But, when the number of sustain pulses as well as the number of subfields increases as in the second factor, gray-scale representation is achieved by an increase in the address light according to the increased number of subfields in addition to the increased number of sustain pulses as in the conventional method, thereby increasing the variation of brightness and making smooth brightness representation difficult to achieve.

The subfield light increases with an increase in the address light, when the number of subfields for the higher one of the two adjacent gray scales is greater than that for the lower one as in the second factor. In this case, more smooth gray-scale representation can be achieved by reducing the increment of the number of sustain pulses relative to the prior art.

Accordingly, when the number of subfields for the higher one of the two adjacent gray scales is greater than that for the lower one, the weight of each subfield is controlled so that the increment of the number of sustain pulses from the lower gray scale to the higher one should be reduced relative to the prior art. In the embodiment of the present invention, the address light is high enough to approach the 1- or 2-unit sustain light and the light structure of each gray scale is comprised of the address light and the number of sustain pulses. So, the number of sustain pulses necessary for representation of a corresponding gray scale can be reduced relative to the prior art.

FIG. 4(*a*) shows the weight and the number of sustain pulses by subfields in a PDP according to an embodiment of the present invention, and FIG. 4(*b*) shows a subfield structure by gray scales represented with a combination of the weights by subfields of FIG. 4(*a*) and the resultant light structure.

In the embodiment of the present invention, as shown in FIGS. 4(*a*) and 4(*b*), the number of sustain pulses for the third subfield having a weight of 1 is zero, and that for the other subfields is reduced by two relative to the prior art.

The address light has an insignificant magnitude, for example, as high as the 1- or 2-unit sustain light, so it can be allocated only to the gray scale 1 and the number of sustain pulses for the third subfield having a weight of 1 is zero. This means that the number of sustain pulses is reduced by 3 relative to the prior art.

As can be seen from the case of gray scales 6 and 7, the increment of the number of sustain pulses is at least 3 when the number of subfields for the higher one of the two adjacent gray scales is less than that for the lower one.

For the light structures of gray scales 6 and 7 being 3A+8 and 2A+11, respectively, and the address light equal to or greater than the unit sustain light, i.e., $A \geqq 1$, in this case, the difference of gray scales 7 and 6 is given by the following equation.

$$(2A+11)-(3A+8)=3-A>0 \quad \text{[Equation 4]}$$

It can be seen from the equation 4 that the gray scale 7 exhibits a greater brightness than the gray scale 6 to achieve correct gray-scale representation even though the address light is equal to or greater than the unit sustain light.

In addition, when the number of subfields for the higher one of two adjacent gray scales (e.g., gray scales 2 and 3, 5 and 6, or 8 and 9) is greater than that for the lower one, the address light is increased by one and the increment of the number of sustain pulses is zero. Namely, the number of sustain pulses is constant for the two adjacent gray scales when the number of subfields for the one gray scale is greater than that for the other one.

As described above, a smooth gray-scale representation can be achieved by adjusting the number of sustain pulses in consideration of the address light.

And, the total number of sustain pulses necessary to the embodiment of the present invention decreases relative to the prior art (refer to FIG. 2(*b*)), thereby reducing power consumption for generation of sustain pulses.

While this invention has been described in connection with what is presently considered to be a practical and exemplary embodiment, it is to be understood that the invention is not limited to the disclosed embodiments, but, on the contrary, is intended to cover various modifications and equivalent arrangements included within the spirit and scope of the appended claims.

According to the present invention, the reversion of gray scales that occurs when the address light is increased as high as the sustain light can be eliminated to achieve correct gray-scale representation.

Furthermore, a more smooth gray-scale representation can be achieved with reduced power consumption by adjusting the difference of the number of sustain pulses between the two adjacent gray scales in consideration of the address light.

What is claimed is:

1. A method of representing a gray scale for a plasma display panel comprising a plurality of discharge cells, the method comprising:

dividing one frame into a plurality of subfields, each subfield comprising an address period for providing at least one address pulse and a sustain period for providing none or at least one sustain pulse;

representing a first gray level utilizing N1 subfield or subfields among the plurality of subfields in at least one of the plurality of discharge cells, N1 being a natural number; and representing a second gray level utilizing N2 subfield or subfields among the plurality of subfields in at least one of the plurality of discharge cells, the second gray level being higher than the first gray level, and N2 being a natural number, wherein a difference between K1 and K2 is greater than a difference between N1 and N2 when N1 is greater than N2, wherein K1 is a number of sustain pulses utilized when representing the first gray level and is an integer equal to or greater than zero, and K2 is a number of sustain pulses utilized when representing the second gray level and is an integer equal to or greater than zero.

2. The method of claim 1, wherein the first gray level is adjacent to the second gray level.

3. A method of representing a gray scale for a plasma display panel comprising a plurality of discharge cells, the method comprising:

dividing one frame into a plurality of subfields, each subfield comprising an address period for providing at least one address pulse and a sustain period for providing none or at least one sustain pulse;

representing a first gray level utilizing N1 subfield or subfields among the plurality of subfields in at least one of the plurality of discharge cells, N1 being a natural number;

representing a second gray level utilizing N2 subfield or subfields among the plurality of subfields in at least one of the plurality of discharge cells, the second gray level being higher than the first gray level, and N2 being a natural number; and representing a third gray level utilizing N3 subfield or subfields among the plurality of subfields in at least one of the plurality of discharge cells, the third gray level being higher than the second gray level, and N3 being a natural number, wherein a difference between K2 and K3 is greater than a difference between K1 and K2 when N2 is greater than each of N1 and N3, wherein K1 is a number of sustain pulses utilized when representing the first gray level and is an integer equal to or greater than zero, K2 is a number of sustain pulses utilized when representing the second gray level and is an integer equal to or greater than zero, and K3 is a number of sustain pulses utilized when representing the third gray level and is an integer equal to or greater than zero.

4. The method of claim 3, wherein a difference between N2 and N3 is less than a difference between K2 and K3.

5. The method of claim 3, wherein K1 is equal to K2.

6. The method of claim 3, wherein the first gray level is adjacent to the second gray level, and the second gray level is adjacent to the third gray level.

* * * * *